US006446311B1

(12) United States Patent
Ueno

(10) Patent No.: US 6,446,311 B1
(45) Date of Patent: Sep. 10, 2002

(54) LOOP PIN

(75) Inventor: Hideyuki Ueno, Kanagawa (JP)

(73) Assignees: Kotec's Co., Ltd., Tokyo (JP); Sanyo Seisakusho Co., Ltd., Nagoya (JP)

( * ) Notice: Subject to any disclaimer, the term of this patent is extended or adjusted under 35 U.S.C. 154(b) by 0 days.

(21) Appl. No.: 09/667,634

(22) Filed: Sep. 22, 2000

Related U.S. Application Data

(63) Continuation-in-part of application No. 09/479,322, filed on Jan. 6, 2000.

(51) Int. Cl.[7] ..... B65D 33/34; B65D 63/00

(52) U.S. Cl. ..... 24/16 R; 24/16 PB; 24/17 AP; 24/30.5 P; 292/319; 292/321

(58) Field of Search ..... 24/16 R, 16 PB, 24/17 AP, 30.5 P; 292/321, 322, 319

(56) References Cited

U.S. PATENT DOCUMENTS

| | | | | | |
|---|---|---|---|---|---|
| 2,648,879 | A | * | 8/1953 | Patterson | 24/16 R |
| 3,048,906 | A | * | 8/1962 | Patterson | 24/30.5 P |
| 3,072,986 | A | * | 1/1963 | Lefnaer | 24/30.5 P |
| 3,466,077 | A | * | 9/1969 | Moberg | 24/16 PB |
| 3,712,655 | A | * | 1/1973 | Fuehrer | 292/321 |
| 3,718,355 | A | | 2/1973 | Canter | 292/321 |
| 3,816,879 | A | * | 6/1974 | Merser et al. | 24/16 PB |
| 3,954,295 | A | * | 5/1976 | Harley | 292/319 |
| 4,059,300 | A | * | 11/1977 | Moberg et al. | 24/16 PB |
| 4,417,656 | A | | 11/1983 | Kato | 206/346 |
| 4,420,857 | A | * | 12/1983 | Clay | 24/30.5 P |
| 4,561,153 | A | * | 12/1985 | Matsui | 24/16 PB |
| 4,609,218 | A | * | 9/1986 | Chevillard et al. | 292/320 |
| 4,854,014 | A | * | 8/1989 | Ueno | 24/16 PB |
| 4,946,210 | A | * | 8/1990 | Fuehrer | 292/318 |
| 5,056,837 | A | * | 10/1991 | Fuehrer | 292/307 R |
| 5,908,110 | A | | 6/1999 | Hirai | 206/345 |

FOREIGN PATENT DOCUMENTS

| | | | | |
|---|---|---|---|---|
| DE | 2517003 | * | 11/1975 | 24/16 PB |
| GB | 2103274 | | 2/1983 | |

* cited by examiner

*Primary Examiner*—Victor Sakran
(74) *Attorney, Agent, or Firm*—Greer, Burns & Crain, Ltd.

(57) ABSTRACT

A loop pin with high tensile rupture strength has an insertion head portion with an appropriate mating part on one end and a socket portion comprising a hole for irreversibly passing the insertion head portion provided on the other end, wherein one part of the insertion head portion has formed on it two parallel surfaces along the axial direction thereof.

17 Claims, 7 Drawing Sheets

LOOP PIN

This is a continuation-in-part, of application Ser. No. 09/479,322, filed Jan. 6, 2000.

BACKGROUND OF THE INVENTION

1. Field of the Invention

The present invention relates to a loop pin that attaches a tag such as a brand label, a price tag, a material description tag, or an instruction tag of a product such as clothing, shoes, or a bag, and more particularly to loop pin assembly in which a plurality of such loop pins are paralelly arranged to each other with closed distance formed therebetween each detatchably connected to connecting bars and each loop pin is used by separating same from the assembly utilizing a specially designed gun or the like each one after other.

2. Description of the Related Arts

A variety of types of loop pins have been used in the past to tie up such products as clothing, sundries, sandals, and shoes, and to attach such items as brand labels or price tags thereto.

For example, such a loop pin 1 has a filament 7 that is passed through the tag to form a loop, an insertion head portion 5 being provided in an end thereof, and a socket portion 6 provided on the other end thereof and having a hole 6*a* through which the head portion 5 passes.

And as shown in FIGS. 19 and 20, a plurality of loop pins are temporarily attached in parallel to each other to two parallely arranged connection bars 2, 3 enabling their easy removal therefrom.

A loop pin 1 is integrally formed of, for example, a synthetic resin material, such as nylon or polypropylene and has an extremely high resistance to tensile stress. When the insertion head portion 5 is passed through the narrow part (blade part) of the socket portion 6, blades provided in the region of the insertion hole open, so that the insertion head portion 5 is held within the socket portion 6 so that it cannot be reversed out therefrom, thereby completing the attachment of the looped label.

However, in the past, when such loop pin assembly in which a plurality of loop pins are removably and temporally connected to the connecting bars, is used, is has been required from a production cost point of view, that a pitch formed among those loop pins paralelly arranged to each other, should be set at fine distance as possible.

However, when such pitch would be shortened, a separate problem would be arisen in that a certain amount of strength of a connecting portion of the loop pin is not necessarily obtained.

FIG. 18 is a partial cross-section view of the mated condition between an insertion head portion 5 an a socket portion 6 of a loop pin according to the prior art. In the past, a small-diameter part 5*b* that connected an end portion 5*a* of the insertion head portion 5 and the base end 5*c* was generally formed by two steps.

In the area surrounding the insertion hole 6*b* of the socket portion 6, a pair of locking blades 6*a* were provided on the left and right. Additionally, the locking blades 6*a* protrude from a base part 6*c* having substantially the same radius as the filament 7.

With the above-noted loop pin according to the prior art, however, from the production cost as well as characteristic of the product, there has been a new movement in that the material of the loop pin 1 had been changed from Nylon to Polypropylene in these years.

However, generally speaking strength of Polypropylene resin is relatively lower than that of Nylon and accordingly, it would be necessary to set each of dimensions of such loop pin 1 at a size relatively larger than those of the loop pin made of Nylon.

Accordingly, when a same level of the break strength of a connected portion of a loop pin made of Nylon and formed when an insertion head portion 5 is inserted into a socket portion 6 would be realized with the loop pin made of Polypropylene, a width of the socket portion 6 is necessarily increased and thus a pitch of the loop pins 1 formed therebetween when they are arranged in parallel with each other as a loop assembly, would probably exceed over 3.5 mm.

Thus when a unit length L of the loop assembly is restricted, a number of the loop pins arranged in the unit length L of the loop pin assembly have to be reduced causing an efficiency for providing such loop pin into goods would be greatly reduced.

On the other hand, when if the pitch formed among the loop pins is shortened, a thickness of the socket portion would necessarily be reduced so that it would be difficult to obtain a desired break strength of the connecting portion of the loop pin.

Further, as shown in FIG. 18, when the insertion head portion 5 is inserted into the hole 6*a* of the socket portion 6, because of the rocking of the insertion head portion 5 in the direction of the arrows E, an uneven force is applied to the locking blades 6*a*, which lead to the possible damage of the locking blades.

Additionally, because the locking blades of the prior art were weak and had ends that could be easily deformed up and down and to the left and right, with even a small change in the insertion head portion, the mated part of the insertion head portion could become unattached.

Additionally, when a plurality of prior art loop pins were temporarily attached in parallel to two connection bars, it was not possible to achieve a small loop pin spacing, because of the limitation imposed by the diameter of the insertion head portion.

Accordingly, it is an object of the present invention to provide a loop pin made of nylon, polypropylene or the like, which features restricted rocking of the head thereof, and prevention of damage to the locking blades.

Another object of the present invention is to provide a loop pin made of Polypropylene having a sufficient break strength of the connecting portion thereof even in a case in that each one of the loop pins having a compact dimension so that each of the loop pins can be parallely arranged to each other with a tine pitch formed therebetween removably connected to the connecting bars.

SUMMARY OF THE INVENTION

In order to achieve the above-noted objects, the present invention has the following basic technical constitution.

Specifically, the present invention is a loop pin in a loop pin assembly in which a plurality of loop pins, each comprising a flexible filament, an insertion head portion provided on one end portion of the filament and having an appropriate mating part and a socket portion provided on the other end of the filament and having a hole for irreversibly passing the insertion head therethrough, the filament, the insertion head portion and the socket portion being integrally formed into one body, are arranged in parallel with each other through connecting bars to which a part of each of the loop pins being detatchably connected thereto, the loop pin being configured so that the insertion head portion and the socket portion are capable to be connected to each other between the mating part formed on an edge portion of the insertion head portion and provided in a vicinity of a connecting portion formed between the insertion head portion and the filament and a step-like portion provided within the through hole formed within the socket portion, and further wherein the loop pin being made of polypropylene and a pitch formed among the plurality of the loop pins parallely arranged to each other being set at less than 3.5 mm, preferably less than 3.1 mm, and break strength of the connected portion when the insertion head portion and the socket portion are mated to each other, being at least 5.0 kg.

A second aspect of the present invention is a loop pin which comprising a flexible filament, an insertion head portion provided on one end portion of the filament and having an appropriate mating part and a socket portion provided on the other end of the filament and having a hole for irreversibly passing the insertion head therethrough, the filament, the insertion head portion and the socket portion being integrally formed into one body, the loop pin being configured so that the insertion head portion and the socket portion are capable to be connected to each other between the mating part formed on an edge portion of the insertion head portion and provided in a vicinity of a connecting portion formed between the insertion head portion and the filament and a step-like portion provided within the through hole formed within the socket portion, and further wherein the loop pin being made of polypropylene and break strength of the connected portion when the insertion head portion and the socket portion are mated to each other, being at least 5.0 kg.

A third aspect of the present inventions relate to a loop pin made of either one of Nylon or Polypropylene and having an improved beak strength at the connecting portion formed by the insertion head portion and the socket portion, and, for example, a loop pin which comprising a flexible filament, an insertion head portion provided on one end portion of the filament and having an appropriate mating part and a socket portion provided on the other end of the filament and having a hole for irreversibly passing the insertion head therethrough, the filament, the insertion head portion and the socket portion being integrally formed into one body, and further wherein two flat surfaces parallely arranged to each other are formed on a part of the insertion head portion along the axial direction.

And further aspect of the present invention is a loop pin which comprising a flexible filament, an insertion head portion provided on one end portion of the filament and having an appropriate mating part and a socket portion provided on the other end of the filament and having a hole for irreversibly passing the insertion head therethrough, the filament, the insertion head portion and the socket portion being integrally formed into one body, and wherein a pair of locking blades are formed on an inside side surface of the through hole provided in the socket portion, and further wherein a thickness of a base part of the locking blades is thicker than the radius of the filament.

DETAILED DESCRIPTION OF THE PREFERRED EMBODIMENTS

Specific embodiments of the present invention will be explained hereunder with reference to the attached drawings.

In order to overcome the problems in the prior art, the present invention provide a loop pin in a loop pin assembly in which a plurality of loop pins, each comprising a flexible filament, an insertion head portion provided on one end portion of the filament and having an appropriate mating part and a socket portion provided on the other end of the filament and having a hole for irreversibly passing the insertion head therethrough, the filament, the insertion head portion and the socket portion being integrally formed into one body, are arranged in parallel with each other through connecting bars to which a part of each of the loop pins being detatchably connected thereto, the loop pin being configured so that the insertion head portion and the socket portion are capable to be connected to each other between the mating part formed on an edge portion of the insertion head portion and provided in a vicinity of a connecting portion formed between the insertion head portion and the filament and a step-like portion provided within the through hole formed within the socket portion, and further wherein the loop pin being made of polypropylene with combining a several specific configuration thereto so as to obtain a loop pin having an improved break strength with a small diameter of the socket portion.

And further, in the present invention, it is provided that a loop pin which comprising a flexible filament, an insertion head portion provided on one end portion of the filament and having an appropriate mating part and a socket portion provided on the other end of the filament and having a hole for irreversibly passing the insertion head therethrough, the filament, the insertion head portion and the socket portion being integrally formed into one body, and further wherein two flat surfaces parallely arranged to each other are formed on a part of the insertion head portion along the axial direction.

Further, in the present invention, it is provided that A loop pin which comprising a flexible filament, an insertion head portion provided on one end portion of the filament and having an appropriate mating part and a socket portion provided on the other end of the filament and having a hole for irreversibly passing the insertion head therethrough, the filament, the insertion head portion and the socket portion being integrally formed into one body, and wherein a pair of locking blades are formed on an inside side surface of the through hole provided in the socket portion, and further wherein a thickness of a base part of the locking blades is thicker than the radius of the filament.

Figure 1:
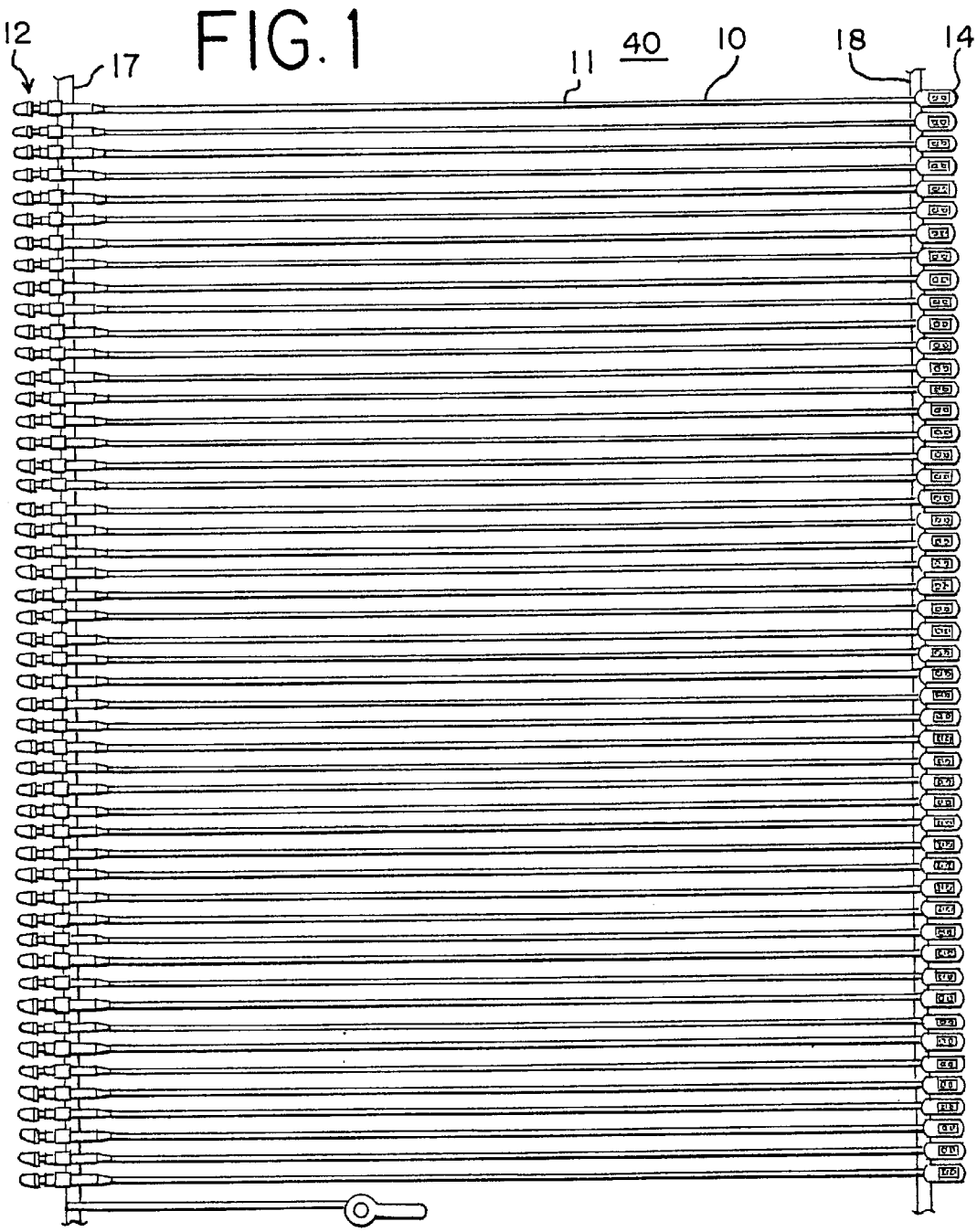
FIG. 1 shows a plan view illustrating a loop pin assembly of the present invention in which a plurality of loop pins are parallely arranged to each other.
Figure 2:
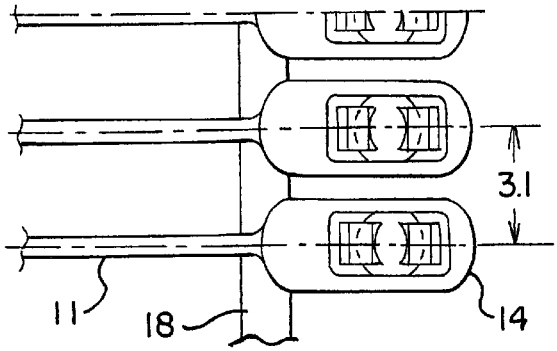
FIG. 2 shows an enlarged plan view illustrating a socket portion of the loop pin of the present invention.

Specifically, FIG. 1 is a plan view showing an example of a loop pin assembly according to the present invention, FIG. 2 is an enlarged plan view of a socket portion of a loop pin of the present invention.

Figure 3:
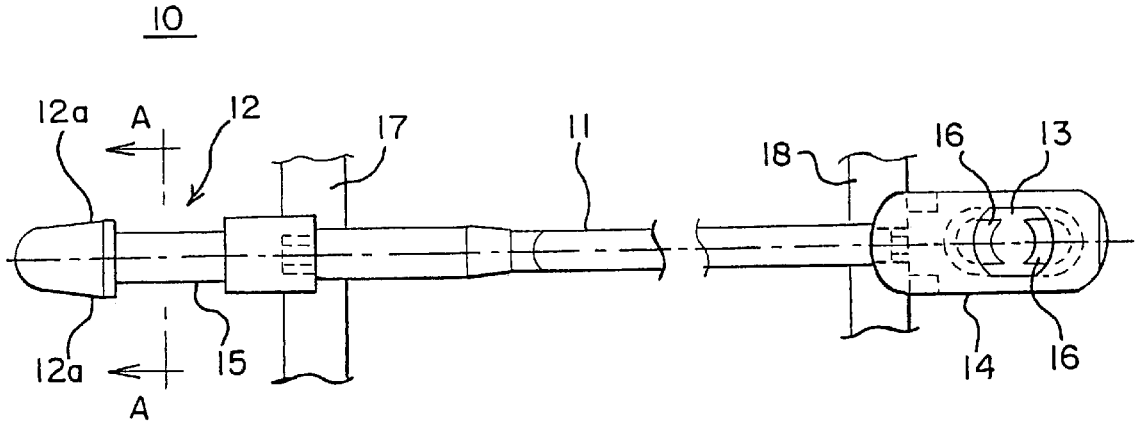
FIG. 3 is plan view showing an example of a loop pin according to the first embodiment of the present invention.
Figure 4:
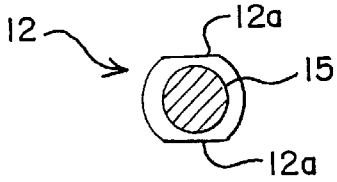
FIG. 4 is a cross-section view in the direction of the line A—A shown in FIG. 3.

Further, FIG. 3 is a plan view of one embodiment of the loop pin of the present invention while FIG. 4 shows a cross-section view in the direction of the line A—A in FIG. 3.

Figure 5:
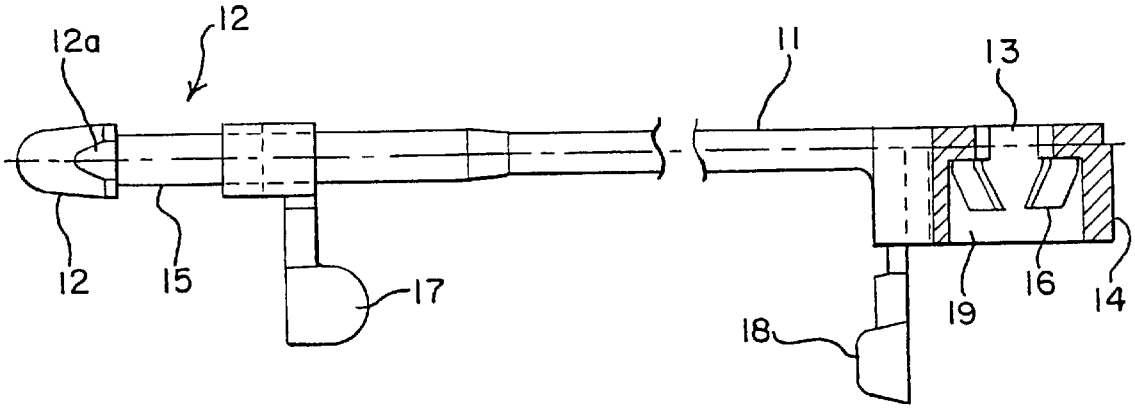
FIG. 5 is a side view of the loop pin of the present invention with part of the socket portion cut away.

On the other hand, FIG. 5 is a side view of the loop pin of the present invention with part of the socket portion cut away.

As shown in these drawings, in a loop pin assembly 40 in which a plurality of loop pins 10, each comprising a flexible filament 11, an insertion head portion 12 provided on one end portion of the filament 11 and having an appropriate mating part and a socket portion 14 provided on the other end of the filament 11 and having a hole 6 for irreversibly passing the insertion head 12 therethrough, the filament 11, the insertion head portion 12 and the socket portion 14 being integrally formed into one body, are arranged in parallel with each other through connecting bars 17, 18 to which a part of each of the loop pins 11 being detatchably connected thereto, the loop pin 10 being configured so that the insertion head portion 12 and the socket portion 14 are capable to be connected to each other between the mating part formed on an edge portion of the insertion head portion 12 and provided in a vicinity of a connecting portion formed between the insertion head portion 12 and the filament 11 and a step-like portion provided within the through hole formed within the socket portion, and further wherein the loop pin being made of polypropylene and a pitch formed among the plurality of the loop pins parallely arranged to each other being set at less than 3.5 mm, preferably less than 3.1 mm, break strength of the connected portion when the insertion head portion 12 and the,socket portion 14 are mated to each other, being at least 5.0 kg.

Further in the present invention, the loop pin 10 comprises a flexible filament 11, an insertion head portion 12 provided on one end portion of the filament 11 and having an appropriate mating part and a socket portion 14 provided on the other end of the filament 11 and having a hole 13 for irreversibly passing the insertion head 12 therethrough, the filament 11, the insertion head portion 12 and the socket portion 14 being integrally formed into one body, and further wherein two flat surfaces 12*a* parallely arranged to each other are formed on a part of the insertion head portion 12 along the axial direction.

As shown in FIG. 2, the pitch as formed among the socket portion 14 is set at, for example, about 3.1 mm but it can be set at less than 3.1 mm.

In the present invention, as mentioned above, even though the loop pin of the present invention is made of polypropylene and having a slimed configuration coring with that of conventional loop pin made of polypropylene, it can show break strength of the connecting portion of the loop pin being exceeding 5.0 Kg.

The present invention having the above-mentioned characteristic can be obtained by combination of any one of the above-mentioned new configurations with the material of polypropylene.

Note that break strength of the connecting portion of the loop pin had been measured by a conventional stress-strain measuring tester.

A surface 12*a* is formed on both sides of the axial line of the insertion head portion 12 and the filament 11. The parallel surfaces 12*a* correspond to the vertical diameter of the insertion hole 13 formed in the socket portion 14 on the opposite side of the filament 11. That is, in the present invention what is referred to as the outer diameter of the insertion head portion is the spacing between these two parallel surfaces.

The vertical diameter of the socket portion 14 is formed so as to be shorter than the horizontal diameter. The taper angle of the insertion head portion 12 is approximately 20 degrees.

If this taper angle is made excessively large, the insertion force when the insertion head portion is inserted becomes large, thereby not only making insertion difficult, but leading to locking blade damage. If the taper angle is made excessively small, there is the problem of the insertion head portion tending to fall out. The taper angle of 20 degrees was selected as the appropriate angle in view of these effects.

The small-diameter part 15 continuous with the insertion head portion 12 is formed, in contrast to the prior art, so as to have a uniform diameter.

A pair of locking blades 16 are disposed at the left and right around the insertion hole 13 of the socket portion 14 to prevent insertion head portion pullout. These locking blades 16 mate with the unchamfered side surfaces of the insertion head portion 12, making it possible to achieve a small gap between the insertion head portion 12 and the socket portion 14.

Additionally, when a plurality of loop pins 10 are temporarily attached to connection bars 17 and 18, it is possible to make the spacing between the loop pins 10 small, thereby achieving a compact product.

On the other hand, the loop pin 10 according to the present invention is integrally formed on a synthetic resin such as polypropylene. While the cross-sectional shape of the filament 11 can be circular, in order to facilitate the bending of the filament in a specific direction, it is preferable that the cross-sectional shape be elliptical, the major axis of the cross-section being in a direction that is perpendicular to the direction of bending of the filament 11, in which case the diameter is 1.5 mm or less, and preferably the major axis of the filament is 0.45 to 1.3 mm, so as to achieve a break strength of 5.0 kg or greater. The above-noted filament diameter is preferably the major axis diameter. The filament 11 can also include a non-extended part.

The insertion hole 13 of the socket portion 14 is provided with a small-diameter part 15 connected to the insertion head portion 13, and locking blades 16 which mate with the step part, the locking blades 16 being formed within the insertion hole 13 so as to be deformable.

That is, in the present invention, the small-diameter part 15 is made a non-extended part, so that when rupturing force is applied in the condition in which the insertion head portion 12 and socket portion 14 are mated, the small-diameter part 15 extends, so as to improve the rupture strength.

The loop pin 10 is temporarily attached so as to be parallel to the connection bars 17 and 18. Therefore, after loading into a special gun, by merely pulling a lever one loop pin at a time is removed therefrom so as to attach a label or the like.

Figure 6:
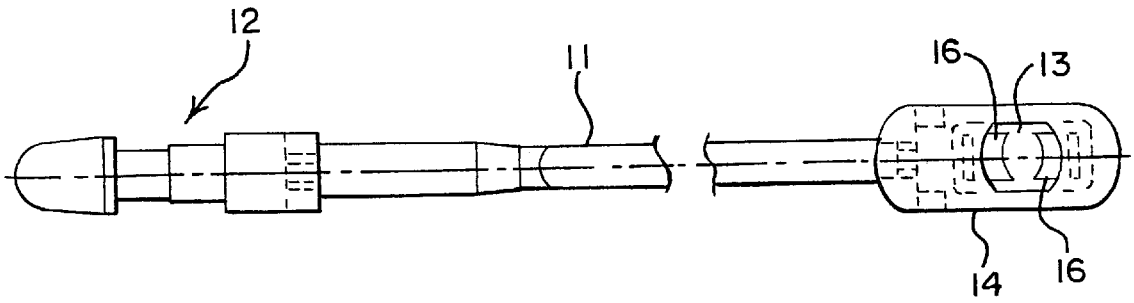
FIG. 6 is a plan view showing the second embodiment of the present invention.
Figure 7:
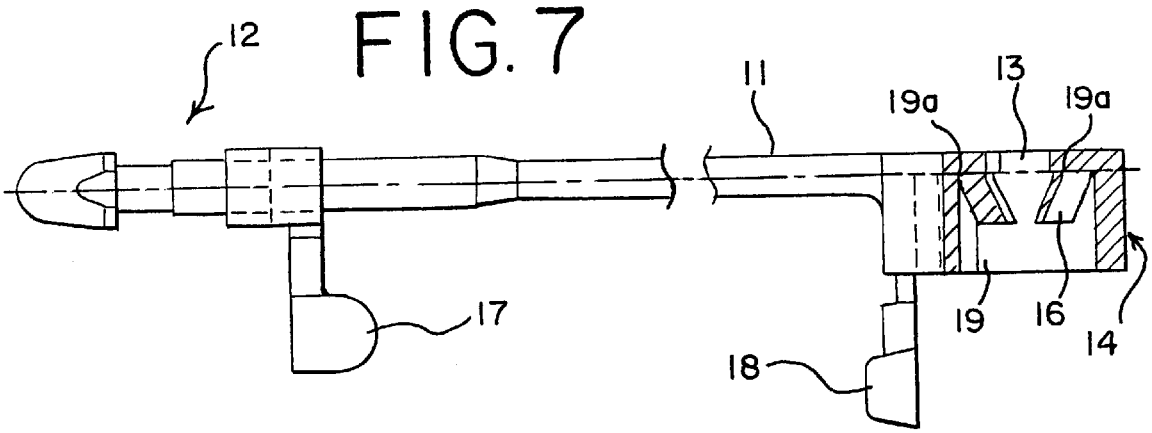
FIG. 7 is a side view of the loop pin of FIG. 6 with part of the socket portion cut away.
Figure 8:
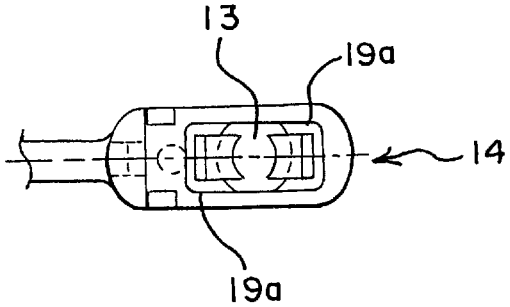
FIG. 8 is a side view showing the socket portion of the loop pin of the present invention.

FIG. 6 is a plan view showing the second embodiment of the present invention, FIG. 7 is a side view of the loop pin of the second embodiment, with part of the socket portion cut away, and FIG. 8 is a side view of the second embodiment, showing the socket portion thereof.

A feature of the second embodiment of the present invention is that corners 19*a* of the concaved portion 19 into which the locking blades 16, 16 are housed in the socket portion 14 of the loop pin are formed as curved surfaces. That is, the corner parts of the concaved portion 19 are chamfered.

By adopting the above-noted configuration, it is possible to prevent a concentration of stress at the corner parts of the concaved portion 19, thereby improving the tensile rupture strength.

Figure 9:
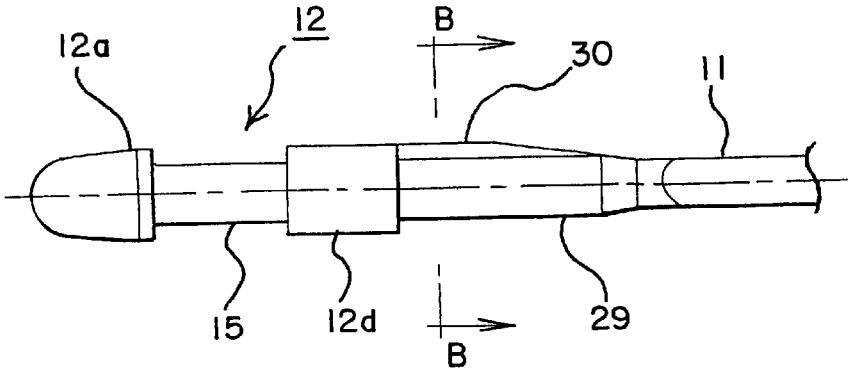
FIG. 9 is a plan view showing the main part of an insertion head portion according to the third embodiment of the present invention.
Figure 10:
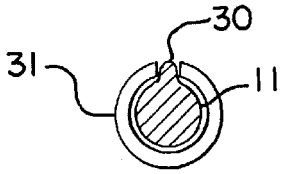
FIG. 10 is a cross-section view in the direction of the line B—B shown in FIG. 9.

FIG. 9 is a plan view showing the main part of an insertion head portion according to the third embodiment of the present invention, and FIG. 10 is a cross-section view in the direction of the line B—B shown in FIG. 9. In this embodiment, the loop pin has a rotation-stopping protrusion 30 at the connection part 29 between the insertion head portion 12 and the filament 11.

The rotation-stopping protrusion 30 is formed as a swelled part on the top of the connecting part 29, and has a height that is substantially the same as the large-diameter part 12*d* of the insertion head portion 12. The rotation-stopping protrusion 30 is maintained at a uniform height for only a prescribed length, beyond which in the direction toward the filament 11 it gradually is reduced in height so as to describe a tapered shape.

If the above-noted configuration is adopted, by loading the loop pins into a special application gun, the rotation-stopping protrusion 30 mates with a slit in a push pin 31 as shown in FIG. 10, thereby enabling application of the loop pin without misalignment of the insertion head portion 12.

Figure 11:
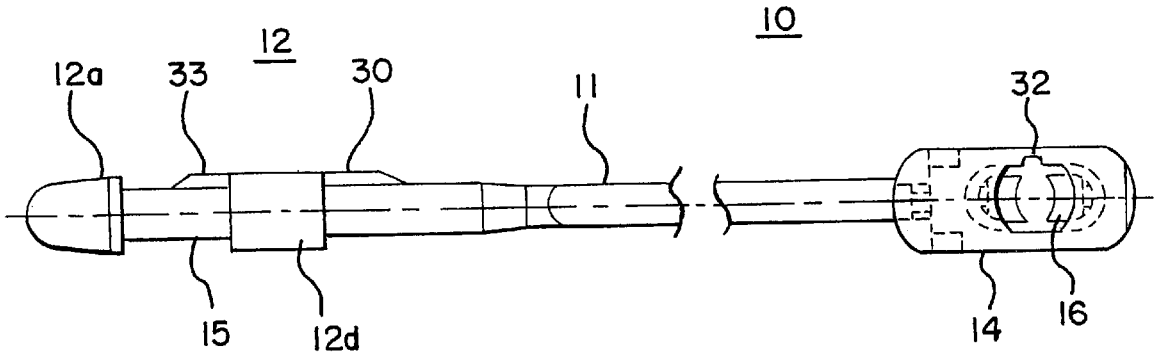
FIG. 11 is a plan view showing the loop pin of fourth embodiment of the present invention.

FIG. 11 is a plan view showing the fifth embodiment of a loop pin according to the present invention. In this embodiment, a depression 32 is formed in the socket portion 14, and a rotation-stopping protrusion 33 that mates therewith is formed on the small-diameter part 15 of the insertion head portion 12.

The rotation-stopping protrusion 33 has a height that is substantially the same as the large-diameter part 12*d* of the insertion head portion 12. It is also possible to provide a rotation-stopping protrusion 30 on the connection part 29 between the insertion head portion 12 and the filament 11, as noted above.

By adopting the above-noted configuration, because of the mating of the rotation-stopping protrusion 33 formed on the insertion head portion 12 with the depression 33 of the socket portion 14, after a loop is formed the insertion head portion 12 does not rotate in relation to the socket portion 14, so that if an attempt is made to remove the insertion head portion 12 from the socket portion 14, the locking blades 16 and the rotation-stopping protrusion 33 act in concert to prevent removal.

Figure 12:
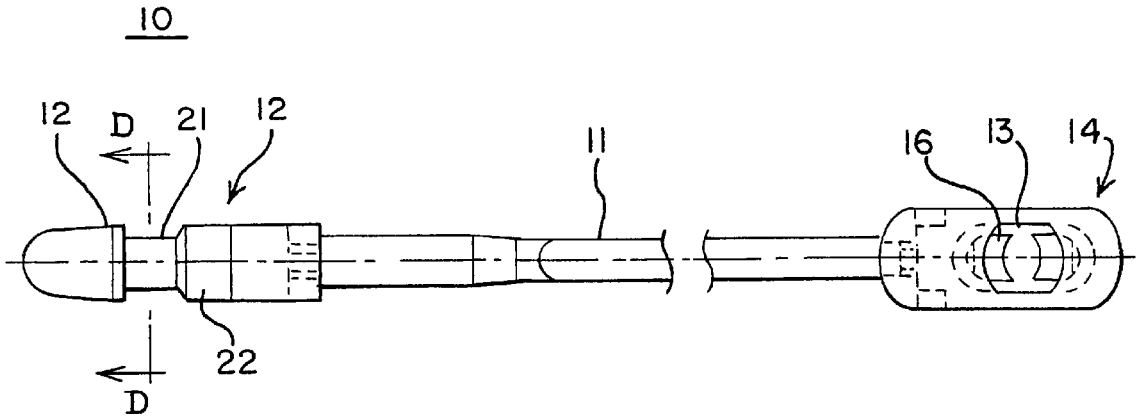
FIG. 12 is a plan view showing the fifth embodiment of the present invention.
Figure 13:
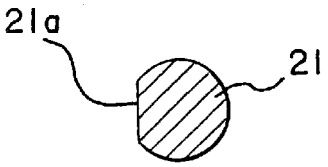
FIG. 13 is a cross-section view in the direction of the line D—D shown in FIG. 10.
Figure 14:
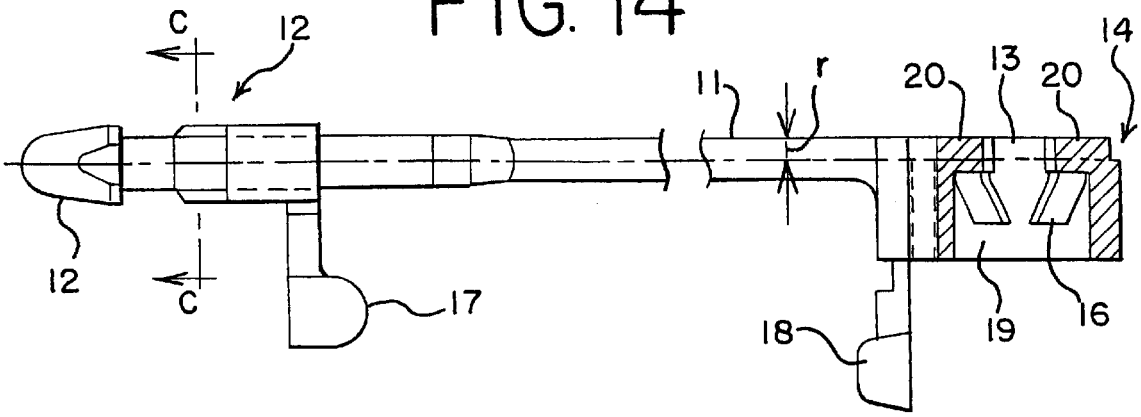
FIG. 14 is a plan view of the sixth embodiment of the present invention, with part of the embodiment cut away.
Figure 15:
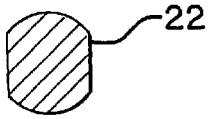
FIG. 15 is a cross-section view in the direction of the line C—C shown in FIG. 14.
Figure 16:
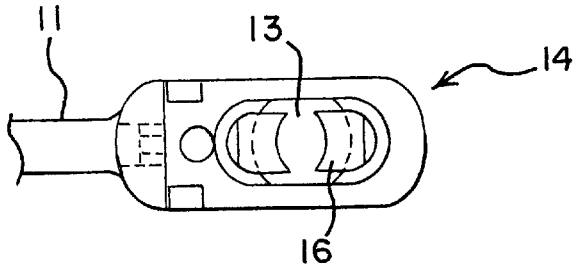
FIG. 16 is a side view showing only the socket portion of the sixth embodiment of the present invention.
Figure 17:
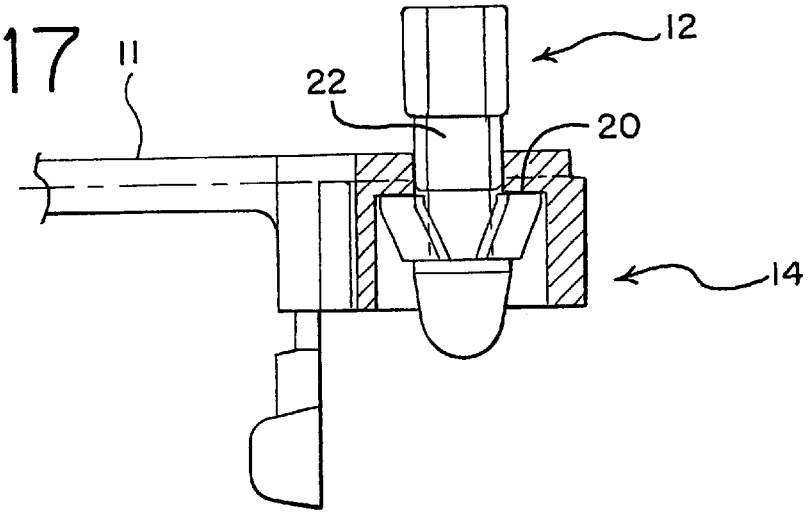
FIG. 17 is a cross-sectional view showing the mating condition between the insertion head portion and the socket portion of a loop pin according to the present invention.
Figure 18:
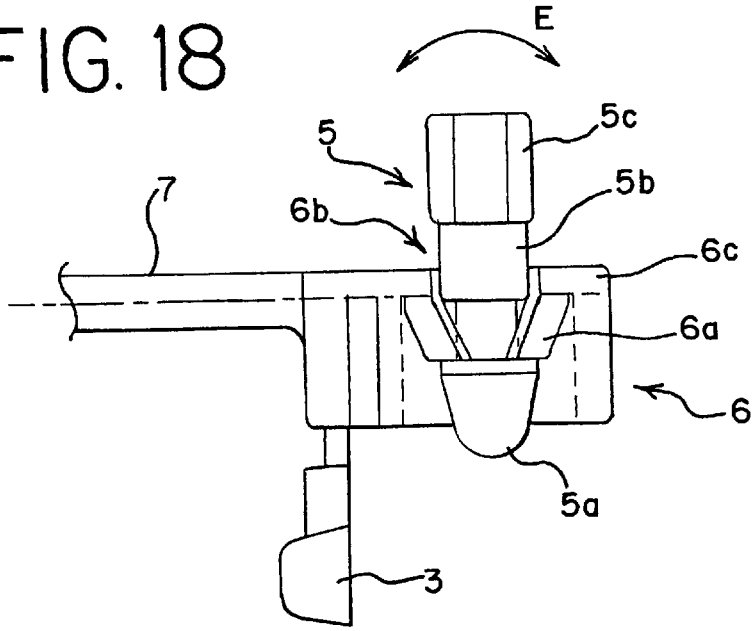
FIG. 18 is a cross-section view showing the mating condition between the insertion head portion and the socket portion of a loop pin according to the prior art.
Figure 19:
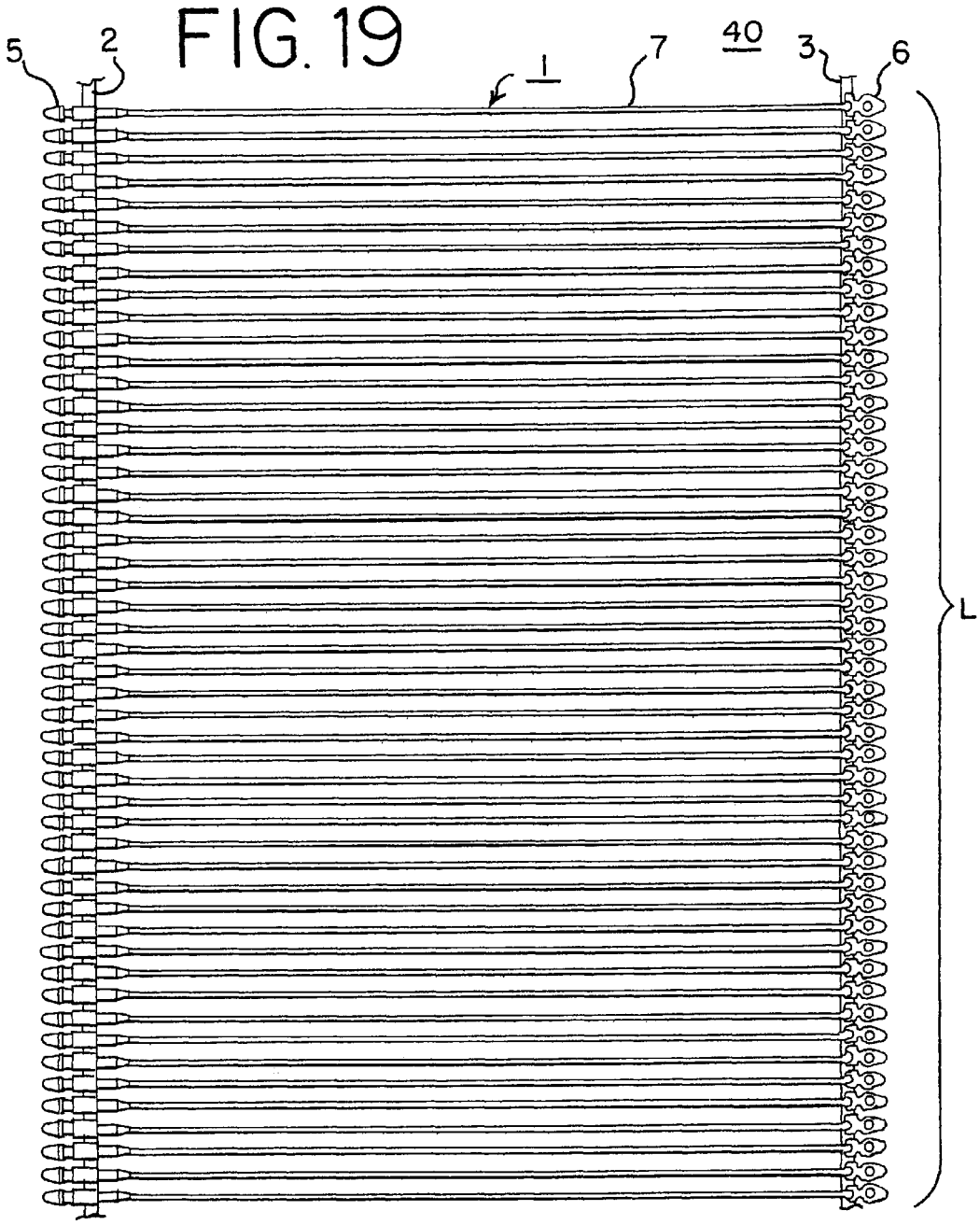
FIG. 19 is a plan view showing a loop pin assembly of a prior art in which a plurality of loop pins are parallely arranged to each other.
Figure 20:
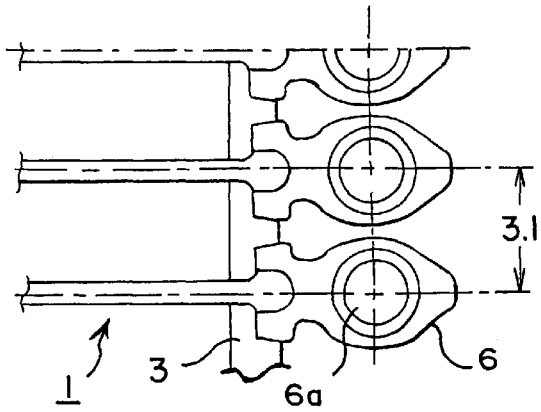
FIG. 20 is an enlarged plan view of a socket portion of a loop pin according to the prior art.

FIG. 12 is a plan view showing the fifth embodiment of the present invention, FIG. 13 is a cross-section view in the direction of the line D—D shown in FIG. 12, FIG. 14 is a plan view of the sixth embodiment of the present invention, with part of the embodiment cut away, FIG. 15 is a cross-section view in the direction of the line C—C shown in FIG. 14, and FIG. 16 is a side view showing only the socket portion of the sixth embodiment of the present invention.

In these embodiments of the present invention, the base ends 20 of the locking blades 16 are made thicker than the radius dimension r of the filament 11. Additionally, there are two steps of small-diameter parts 21 and 22, continuous with the insertion head portion 12, and the small-diameter part 21 is cut so as to have a flat surface 21*a* on part thereof, as shown in FIG. 11.

The small-diameter part 22 has an outer diameter that is substantially the same as the maximum diameter of the insertion head portion 12, and is cut so as to have two parallel surfaces on its sides, as shown in FIG. 15.

By adopting the above-noted configuration, because the base parts 20 of the locking blades 16 are formed so as to be thick, the locking blades are strengthened, and the tensile rupture strength of the loop pin 10 is improved. FIG. 15 is a cross-section view showing the mating condition between the insertion head portion 12 and the socket portion 14 of a loop pin 10 according to this embodiment of the present invention. In this embodiment, because the gap between the insertion hole of the socket portion 14 and the small-diameter part 22 of the insertion head portion 12 is extremely small, after a loop is formed there is no rocking between the insertion head portion 12 and the socket portion 14, and the condition in which an excessive stress is applied to only the locking blades does not occur, making it possible to improve the tensile rupture strength of the loop pin.

It will be understood that the present invention is not restricted to the above-described embodiments, and can take on other variations within the spirit and technical concept described herein.

By adopting the various configurations described above, a loop pin according to the present invention can achieve a high tensile rupture strength, even if the material used is nylon, polypropylene or the like.

In the present invention, as mentioned above, even though the loop pin of the present invention is made of polypropylene and having a slimed configuration comparing with that of conventional loop pin made of polypropylene, it can show break strength of the connecting portion of the loop pin being exceeding 5.0 Kg.

Additionally, loop pins of the present invention can be spaced close together, thereby achieving a compact product. In addition, after formation of a loop, rocking of the insertion head portion is prevented, thereby preventing uneven stress from being applied to the locking blades, for example.

What is claimed is:

1. In a loop pin assembly in which a plurality of loop pins, each comprising a flexible filament, an insertion head portion provided on one end portion of said filament and having an appropriate mating part and a socket portion provided on the other end of said filament and having a hole for irreversibly passing said insertion head therethrough, said filament, said insertion head portion and said socket portion being integrally formed into one body, are arranged in parallel with each other through connecting bars to which a part of each of said loop pins is detachably connected thereto, said loop pin being configured so that said insertion head portion and said socket portion are capable of being connected to each other between said mating part formed on an edge portion of said insertion head portion and provided in a vicinity of a connecting portion formed between said insertion head portion and said filament, and a step-like portion provided within said through hole formed within said socket portion, and further wherein said loop pin is made of polypropylene and a pitch formed along the plurality of said loop pins parallely arranged to each other is set at less than 3.5 mm, preferably less than 3.1 mm, a break strength of said connected portion when said insertion head portion and said socket portion are mated to each other, being at least 5.0 kg.

2. A loop pin according to claim 1, wherein two flat surfaces parallely arranged to each other are formed on a part of said insertion head portion along the axial direction.

3. A loop pin according to claim 1, wherein said loop pin is provided with a small-diameter member on a portion adjacent to said insertion head portion having a uniform diameter.

4. A loop pin according to claim 1, wherein said filament has an elliptical cross-section shape with a minor axis diameter thereof being in a range of 0.45 to 1.3 mm.

5. A loop pin according to claim 1, wherein a pair of locking blades are formed on an inside side surface of said through hole provided in said socket portion, and further wherein a thickness of a base part of said locking blades is thicker than the radius of said filament.

6. A loop pin according to claim 5, wherein corners of an inside surface formed in said through hole in which said locking blades are housed are configured with curved surfaces.

7. A loop pin according to claim 5, wherein said pair of locking blades housed in said socket portion are disposed along a longitudinal direction of said filament.

8. A loop pin according to claim 1, wherein said through hole has a rectangular configuration having a long side, a direction of which coincides with a longitudinal direction of said filament.

9. A loop pin according to claim 1, wherein a part of the outer diameter dimension of said insertion head portion is substantially identical to a diameter of said through hole of said socket portion for irreversibly passing said insertion head portion.

10. A loop pin according to claim 1, said loop pin further comprising a rotation-stopping protrusion at a connection portion between said insertion head portion and said filament for engaging with said socket portion.

11. A loop pin according to claim 1, said loop pin further comprising a rotation-stopping protrusion at a small-diameter part of said insertion head portion for engaging with said socket portion.

12. A loop pin according to claim 1, wherein a thickness of said first surface of said socket portion is thicker than a diameter of said filament.

13. A loop pin according to claim 1, wherein a configuration of a tip end portion of said pair of blades which contact with said mating part of said insertion head is curved shape.

14. A loop pin according to claim 1, wherein at least one of said insertion head inserting hole or said cavity has a configuration being longer in the lateral direction coinciding with the direction of the center axis of said filament.

15. A loop pin according to claim 1, wherein two flat surfaces arranged parallel to each other, are formed on parts being oppositely arranged on said insertion head portion along the axial direction of said filament.

16. A loop pin comprising a flexible filament, an insertion head portion provided on one end portion of said filament and having an appropriate mating part and a socket portion provided on the other end of said filament and having a hole for irreversibly passing said insertion head therethrough, said filament, said insertion head portion and said socket portion being integrally formed into one body, said loop pin being configured so that said insertion head portion and said socket portion are capable of being connected to each other between said mating part formed on an edge portion of said insertion head portion and provided in a vicinity of a connection portion formed between said insertion head portion and said filament and a step-like portion provided within said through hole formed within said socket portion, and further wherein said loop pin is made of polypropylene and a break strength of said connected portion when said insertion head portion and said socket portion are mated to each other is at least 5.0 kg.

17. A loop pin comprises a filament, an insertion head provided on one end portion of said filament and having an appropriate mating part and a socket portion provided on the other end of said filament and having a hole provided with locking blades therein for irreversibly passing said insertion head; said filament, said insertion head and said socket portion being integrally formed into one body, wherein said insertion head includes at least a head portion and a connecting member having a diameter smaller than that of said head portion so that said appropriate mating part can be formed by a step-like portion formed at the connection portion between said head portion and said connecting member, while said socket portion has a first surface and a second surface each being formed in parallel with a center axis of said filament to each other, said hole being provided inside said socket portion penetrating through said first and said second surfaces, a center axis of said hole being perpendicular to said center axis of said filament, said first surface of said socket portion having an insertion head inserting hole portion having a cross-sectional are being substantially identical to or greater than a maximum cross-sectional area of said head portion of said insertion head, and said second surface portion thereof having a cavity holding said head portion of said insertion head therein, a cross-sectional area thereof being larger than that of said insertion head inserting hole portion, and further wherein, a pair of said locking blades are formed on the inside surface of said cavity and are oppositely arranged with each other along a direction of said center axis of said filament, a base portion of each one of said blades being connected to a back surface of said first surface of said socket portion and extending into said cavity inwardly to each other so as to gradually narrow a gap formed therebetween.

* * * * *

UNITED STATES PATENT AND TRADEMARK OFFICE

CERTIFICATE OF CORRECTION

PATENT NO. : 6,446,311 B1
DATED : September 10, 2002
INVENTOR(S) : Hideyuki Ueno It is certified that error appears in the above-identified patent and that said Letters Patent is hereby corrected as shown below:

Column 10,
Line 25, delete “connection portion” insert -- connecting portion --.
Line 52, delete “cross-sectional are” insert -- cross-sectional area --.

Signed and Sealed this

Eighteenth Day of March, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,446,311 B1
DATED : September 10, 2002
INVENTOR(S) : Hideyuki Ueno It is certified that error appears in the above-identified patent and that said Letters Patent is hereby corrected as shown below:

Column 9,
Line 34, delete “minor” and insert -- major -- therefor.

Signed and Sealed this

Twenty-third Day of September, 2003

JAMES E. ROGAN
*Director of the United States Patent and Trademark Office*